US006986535B2

(12) United States Patent
Kawamoto et al.

(10) Patent No.: US 6,986,535 B2
(45) Date of Patent: Jan. 17, 2006

(54) LATCH DEVICE

(75) Inventors: Masanobu Kawamoto, Yokohama (JP); Shigemitsu Tomita, Yokohama (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 10/721,900

(22) Filed: Nov. 26, 2003

(65) Prior Publication Data

US 2004/0169377 A1 Sep. 2, 2004

(30) Foreign Application Priority Data

Feb. 27, 2003 (JP) ..... 2003-051642

(51) Int. Cl.
*E05B 15/02* (2006.01)

(52) U.S. Cl. ..... 292/341.15; 292/DIG. 4; 200/524

(58) Field of Classification Search ..... 292/336.3, 292/DIG. 37, DIG. 4, 341.15, 341.17, 304; 200/520, 523, 524, 341
See application file for complete search history.

(56) References Cited

U.S. PATENT DOCUMENTS 2,565,873 A * 8/1951 Meyer ..... 74/503
3,582,592 A * 6/1971 Schadow ..... 200/524
3,766,346 A * 10/1973 Alexander ..... 200/524
4,771,141 A * 9/1988 Flumignan et al. ..... 200/528
5,292,158 A * 3/1994 Kurosaki ..... 292/45
5,369,237 A * 11/1994 Mejerl et al. ..... 200/524
5,670,762 A * 9/1997 Futamura ..... 200/16 D
5,727,675 A * 3/1998 Leveque et al. ..... 200/524

FOREIGN PATENT DOCUMENTS

| | | |
|---|---|---|
| EP | 0 676 521 | 9/1996 |
| GB | 2 174 193 | 10/1986 |
| JP | 7-14062 | 3/1995 |
| JP | 2586946 | 12/1996 |

* cited by examiner

*Primary Examiner*—Gary Estremsky
(74) *Attorney, Agent, or Firm*—Manabu Kanesaka

(57) ABSTRACT

A latch device includes a movable member and a housing. The movable member is urged with an urging member to a position where a part of the movable member projects from the housing. When the movable member is pushed into the housing against a force of the urging member, a push-push type lock mechanism turns to a lock state and the movable member is locked at a push-in position. When the movable member in the push-in position is pushed into the housing again against the force of the urging member, the lock mechanism turns to an unlock state, so that the movable member is returned to the projecting position. The lock mechanism is provided on front and back surfaces of the movable member as well as on portions of the housing facing the front and back surfaces of the movable member.

7 Claims, 11 Drawing Sheets

LATCH DEVICE

BACKGROUND OF THE INVENTION AND RELATED ART STATEMENT

The present invention relates to a latch device. The latch device is provided with a switch and is attached to an attached member such as a main member of a radio cassette player, so that a door member of the radio cassette is closed or opened when the door member is pushed.

A conventional latch device includes a movable member and a housing. The movable member is urged with an urging member to a position where a part of the movable member projects from the housing. When the movable member is pushed into the housing against a force of the urging member, the movable member is locked at a push-in position where a push-push type lock mechanism turns to a locked state and the switch is turned on. When the movable member in the push-in position is pushed into the housing again against the force of the urging member, the lock mechanism turns to an unlocked state, so that the movable member is returned to the projecting position and the switch is turned off (refer to Patent Reference 1).

Patent Reference 1: Japanese Utility Model No. 7-14062

In the latch device disclosed in Patent Reference 1, the lock mechanism is provided only on one side (front or back surface) of the movable member. Accordingly, due to a single lock mechanism, strength of locking the movable member is not strong enough. Also, the switch is provided on a surface of the movable member opposite to a surface where the lock mechanism is provided. Therefore, it is difficult to make a width of the latch device small.

In view of the problems described above, the present invention has been made, and an object of the present invention is to provide a latch device for locking with higher locking strength through two lock mechanisms. It is also possible to make a width of the latch small by providing the switches on both sides of the movable member.

Further objects and advantages of the invention will be apparent from the following description of the invention.

SUMMARY OF THE INVENTION

According to the present invention, a latch device includes a movable member and a housing. The movable member is urged with an urging member to a position where a part of the movable member projects from the housing. When the movable member is pushed into the housing against a force of the urging member, a push-push type lock mechanism turns to a locked state and the movable member is locked at a push-in position. At this time, the switch is turned on or turned off. When the movable member in the push-in position is pushed into the housing again against the force of the urging member, the lock mechanism turns to an unlocked state, so that the movable member is returned to the projecting position. At this time, the switch is turned on or turned off. The lock mechanism is provided on front and back surfaces of the movable member as well as on portions of the housing facing the front and back surfaces of the movable member.

According to the present invention, the switch may be provided on the front and back surfaces of the movable member as well as on portions of the housing facing the front and back surfaces of the movable member. Terminals composing the switch provided on the front and back surfaces of the movable member may be electrically connected. The terminals provided on the front and back surfaces of the movable member may be formed in a U-shape seen from a direction that the movable member is pushed in.

DETAILED DESCRIPTION OF PREFERRED EMBODIMENTS

Figure 1:
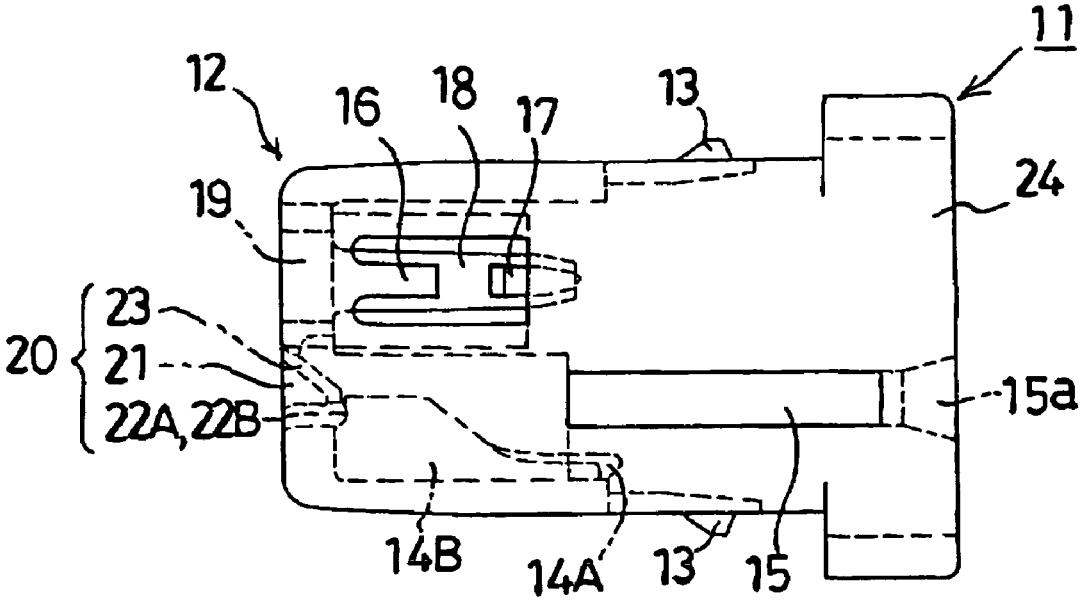
FIG. 1 is a plan view of a housing composing a latch device according to an embodiment of the present invention.
Figure 2:
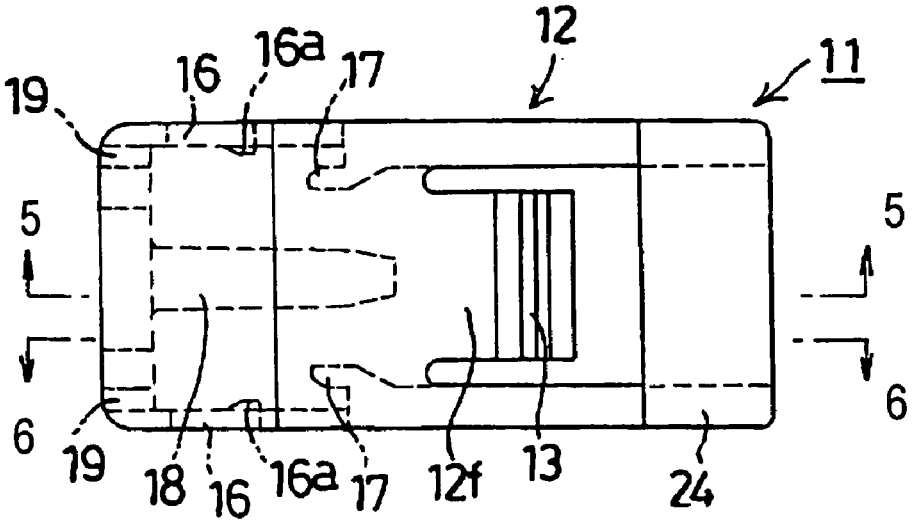
FIG. 2 is a front view of the housing shown in FIG. 1.
Figure 3:
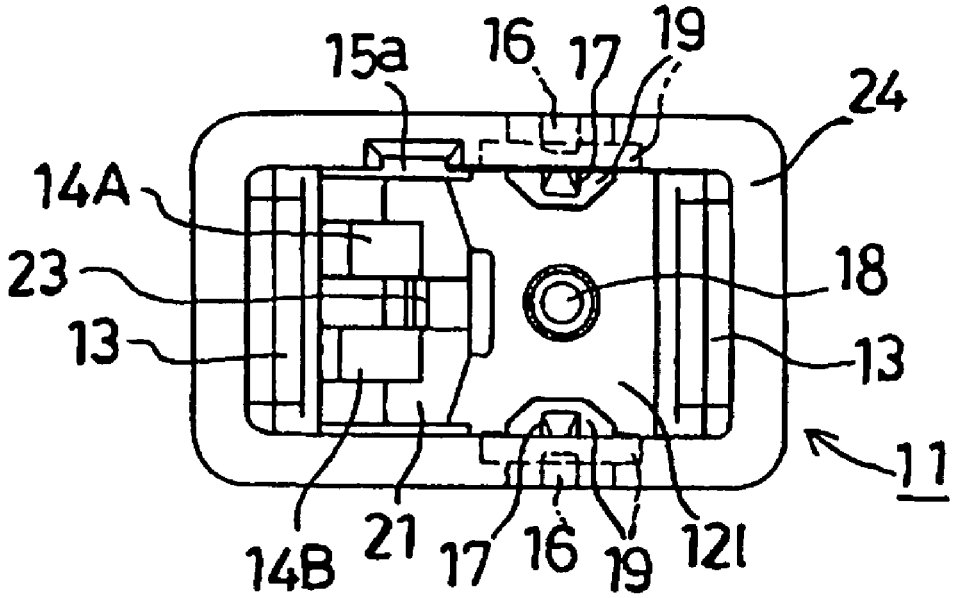
FIG. 3 is a right side view of the housing shown in FIG. 1.
Figure 4:
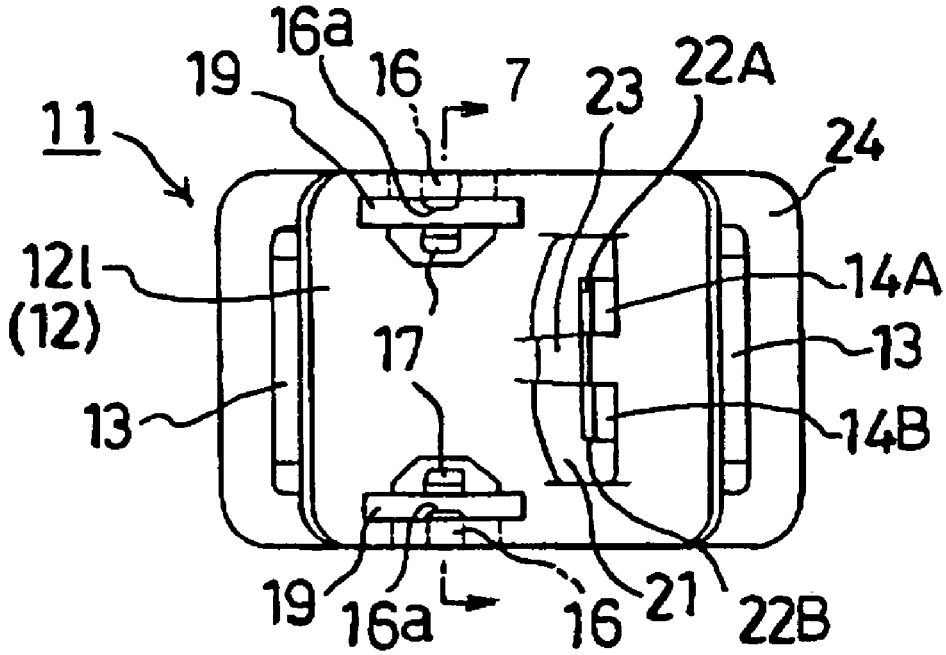
FIG. 4 is a left side view of the housing shown in FIG. 1.
Figure 5:
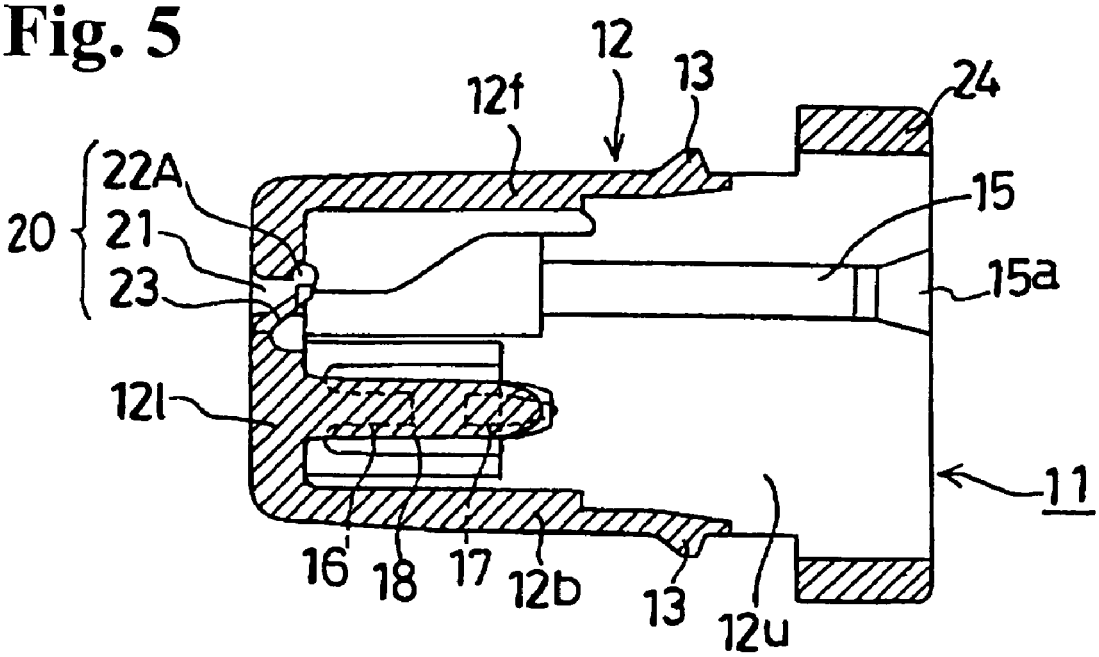
FIG. 5 is a cross sectional view taken along line 5—5 in FIG. 2.
Figure 6:
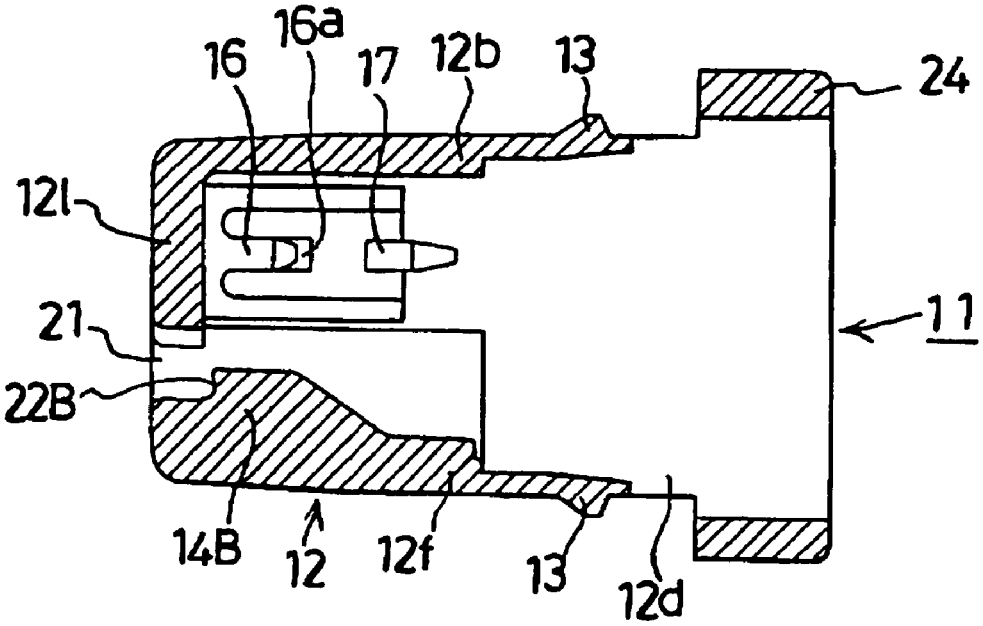
FIG. 6 is a cross sectional view taken along line 6—6 in FIG. 2.
Figure 7:
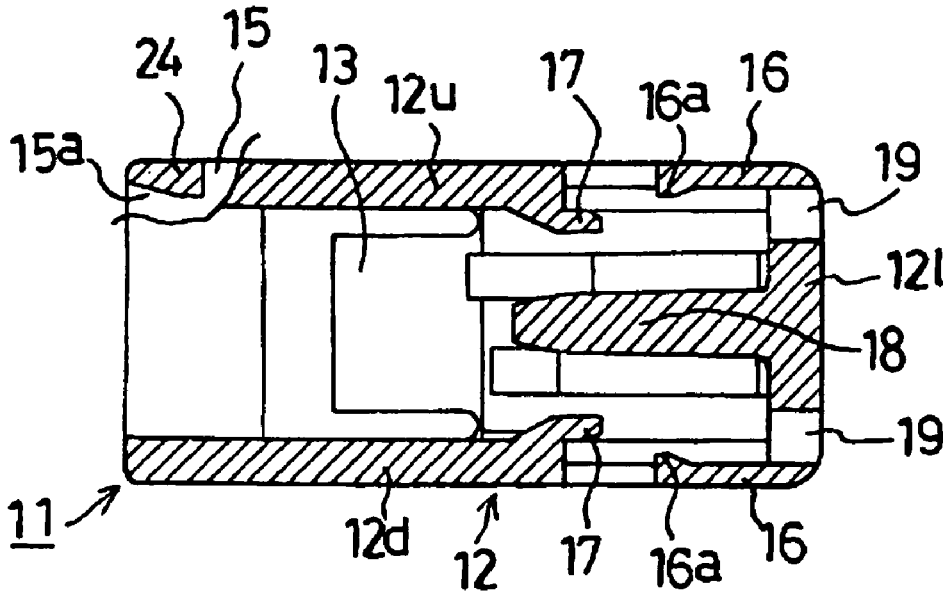
FIG. 7 is a cross sectional view taken along line 7—7 line in FIG. 4.

Hereunder, embodiments of the present invention will be explained with reference to the accompanying drawings. FIG. 1 is a plan view of a housing composing a latch device according to an embodiment of the present invention. FIG. 2 is a front view of the housing shown in FIG. 1; FIG. 3 is a right side view of the housing shown in FIG. 1; and FIG. 4 is a left side view of the housing shown in FIG. 1. FIG. 5 is a cross sectional view taken along line 5—5 in FIG. 2; FIG. 6 is a cross sectional view taken along line 6—6 in FIG. 2; and FIG. 7 is a cross sectional view taken along line 7—7 in FIG. 4. A guide groove communicating with a guide long hole is shown at an upper left of FIG. 7. Hereinafter, up and down directions, and right and left directions correspond to the front view of each member.

In FIGS. 1 to 7, a housing 11 is formed of a synthetic resin. The housing 11 is composed of a box portion 12 having a front surface wall 12*f*, a back surface wall 12*b*, a ceiling wall 12*u*, a bottom wall 12*d*, and a left side surface wall 121; and a short frame portion 24 extending from the ceiling wall 12*u* and the bottom wall 12*d* at the right side of the box portion 12 and having a height same as that of the box portion 12 and a width larger than that of the box portion 12. Accordingly, the housing 11 has an opening at one end thereof (right side, right surface wall)

In the box portion 12, elastic supporting pieces 13 are formed on the front surface wall 12*f* and the back surface wall 12*b* at a side of the frame portion 24, and extend from the left side surface wall 121 to one end of the box portion 12 for sandwiching an attached member with the frame portion 24. A first cam projecting bar 14A and a second cam bar 14B are formed on an inner surface of the front surface wall 12*f* at a side of the left side surface wall 121. The first cam projecting bar 14A and second cam bar 14B horizontally extend in parallel from the left side surface wall 121 to the end of the box portion 12 with an interval in which a flat plate 40 of the movable member 31 is fit to move.

A rectangular long guide hole 15 extending from the left side surface wall 121 toward the end of the box portion 12 up to the frame portion 24 is formed on the ceiling wall 12*u* at a side of the front surface wall 12*f* and a side of the end of the box portion 12 (right side surface). Engagement pieces 16 extending from the left side surface wall 121 toward the end of the box portion 12 are formed on the ceiling wall 12*u* and the bottom wall 12*d* at a side of the back surface wall 12*b* near the left side surface wall 121.

A guide groove 15*a* connected to the guide long hole 15 is formed on an inner surface of the ceiling of the frame portion 24, and reaches a right side edge of the frame portion 24. An engagement projection 16*a* projecting slightly into the box portion 12 is formed on each of the engagement pieces 16 for engaging an engagement hole 72*h* of a fixed terminal 71.

In the box portion 12, holding pieces 17 are formed on the inner surfaces of the ceiling wall 12*u* and the bottom wall 12*d* at positions extending from the engagement pieces 16 for holding ends of the fixed terminals 71 with the ceiling wall 12*u* and the bottom wall 12*d*. A spring receiver 18 is formed on the inner surface of the left side surface wall 121 between the engagement pieces 16 for positioning a coil spring 51 as an urging member (described later), and extends toward the end of the box portion 12 parallel to the ceiling wall 12*u* and the left side surface wall 12*d*. Insertion holes 19 are formed on the inner surface of the left side surface wall 121 at a side of the ceiling wall 12*u* and the bottom wall 12*d* and at positions extending from the engagement pieces 16 and holding pieces 17 for inserting insertion portions 72 of the fixed terminals 71 to prevent rattle.

Furthermore, the box portion 12 is provided with a guide lever attachment portion 20 for attaching a guide lever 61. The guide lever attachment portion 20 includes an insertion hole 21 provided on the left side surface wall 121 for inserting the guide lever 61; depressions 22A and 22B communicating with the insertion hole 21 for rotatably supporting an axial portion 62 of the guide lever 61 provided away from the front surface wall 12*f* on the first cam projecting bar 14A and the second cam bar 14B at a side of the left side surface wall 121; and an elastic pressing piece 23 for pressing the axial portion 62 of the guide lever 61 against the depressions 22A and 22B.

Figure 8:
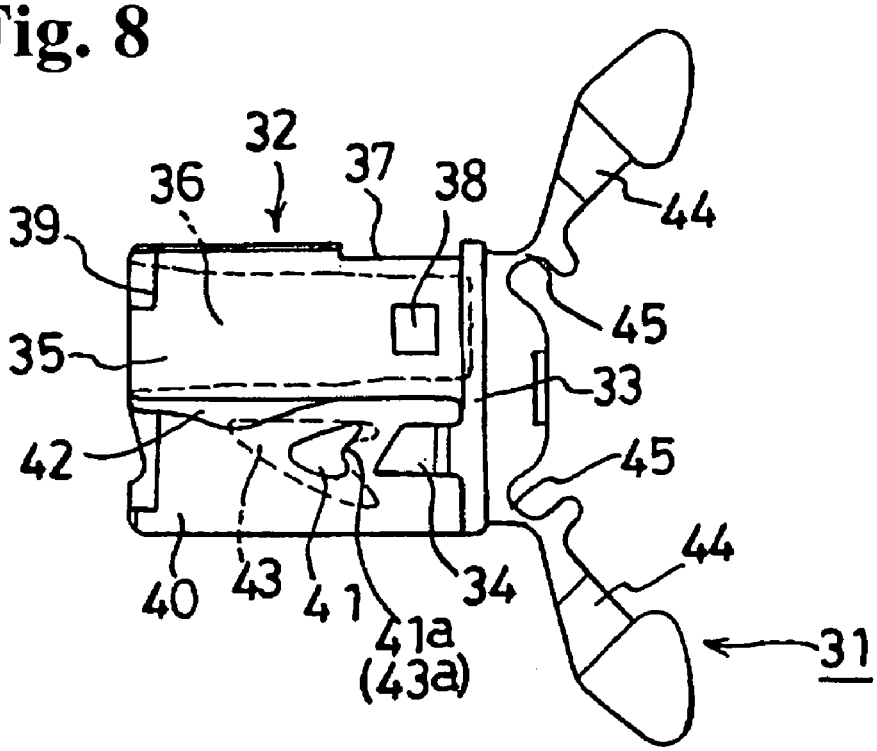
FIG. 8 is a plan view of a movable member composing the latch device according to the embodiment of the present invention.
Figure 9:
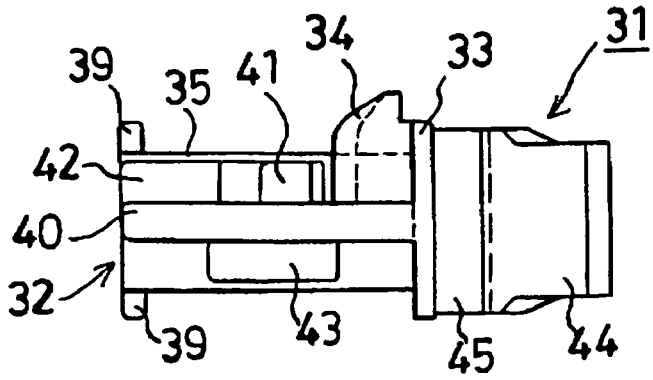
FIG. 9 is a front view of the movable member shown in FIG. 8.
Figure 10:
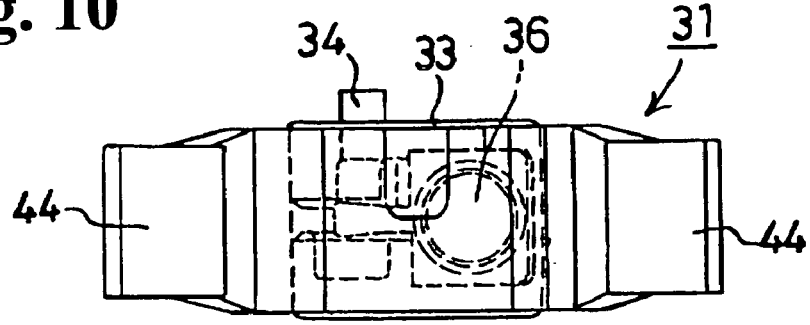
FIG. 10 is a right side view of the movable member shown in FIG. 8.
Figure 11:
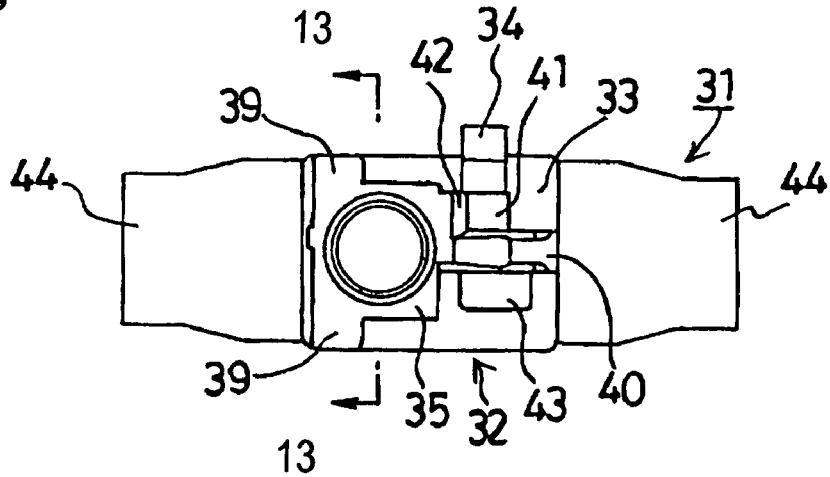
FIG. 11 is a left side view of the movable member shown in FIG. 8.
Figure 12:
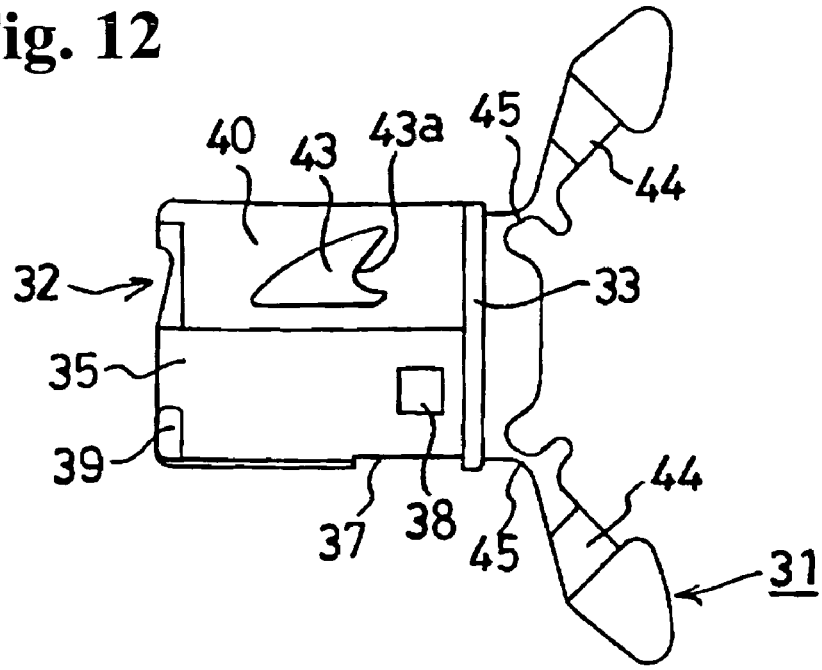
FIG. 12 is a bottom plan view of the movable member shown in FIG. 8.
Figure 13:
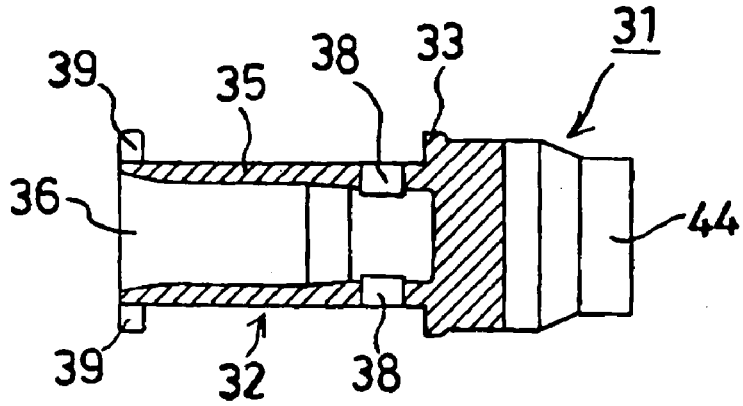
FIG. 13 is a cross sectional view taken along line 13—13 in FIG. 11.

FIG. 8 is a plan view of a movable member composing the latch device according to the embodiment of the present invention. FIG. 9 is a front view of the movable member shown in FIG. 8, FIG. 10 is a right side view of the movable member shown in FIG. 8, FIG. 11 is a left side view of the movable member shown in FIG. 8, FIG. 12 is a bottom plan view of the movable member shown in FIG. 8, and FIG. 13 is a cross sectional view taken along line 13—13 in FIG. 11.

As shown in FIGS. 8 to 11, a movable member 31 is formed of a synthetic resin, and includes a main member 32 to be inserted into the housing 11; and supporting or engaging pieces 44 with hinge portions 45 formed at ends of the front surface and the back surface of the main member 32 for supporting and releasing a striker S (described later).

The main member 32 includes a front wall 33 at a right end thereof having a rectangular shape in a side view and the supporting pieces 44; an engagement projection 34 formed on an upper side of a back surface of the front wall 33 and having an upper surface inclined downwardly to the left and an inclined back surface (cam surface) with a notched left corner corresponding to the guide long hole 15 of the housing 11; a square pole (columnar portion) 35 formed on a half of the back surface of the front wall 33, extending toward a left side and having steps relative to top and bottom of the front wall 33; and a flat plate (plate portion) 40 formed on a half of the front surface of the front wall 33 at the middle of the square pole 35 in a height direction and extending horizontally toward a left side of the front wall 33 and the square pole 35.

A circular hole 36 is formed on a left end surface of the square pole 35 for housing a coil spring 51 extending toward a right side. A housing step portion 37 is formed on a back surface of the square pole 35 connected to the front wall 33 for holding a connecting piece 83 of a movable terminal 81 (described later). Engagement holes 38 passing through vertically are formed in a front surface of the square pole 35 at a right end corresponding to the housing step portions 37 for engaging engagement projections 84*a* of the movable terminal 81. Protection and guide projections 39 extending to a height same as the front wall 33 are formed on a left end of the square pole 35 at top and bottom corners near the back surface.

A first heart cam 41 including a first cam depression 41*a* and a first cam projection 42 for guiding a first trace portion 63*a* (described later) of the guide lever 61 is formed on an upper surface of the flat plate 40. A second heart cam 43 including a second cam depression 43*a* is formed on a lower surface of the flat plate 40. The inclined plane (cam surface) of the engagement projection 34, the first cam projecting bar 14A, the second cam projecting bar 14B, the first heart cam 41, the first cam projection 42, and the second heart cam 43 are arranged to generate a torsional force or a bending force on the axial portion 62 of the guide lever 6 when a distance between a first trace portion 63*a* and a second trace portion 64*a* is changed. The torsional force or the bending force generates a restoring force on the first trace portion 63*a* or the second trace portion 64*a* in a circulation direction.

The lock mechanism is composed of the inclined surface (cam surface) of the engagement projection 34; the first cam projecting bar 14A; the second cam projecting bar 14B; the first heart cam 41; the first cam projection 42; the second heart cam 43 (coil spring 51); and the guide lever 61.

Figure 14:
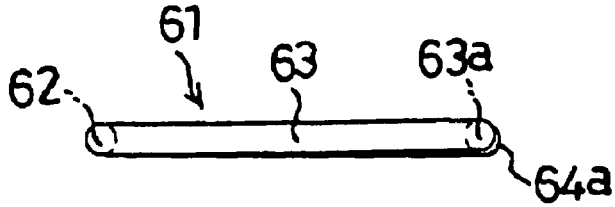
FIG. 14 is a plan view of a guide lever composing the latch device according to the embodiment of the present invention.
Figure 15:
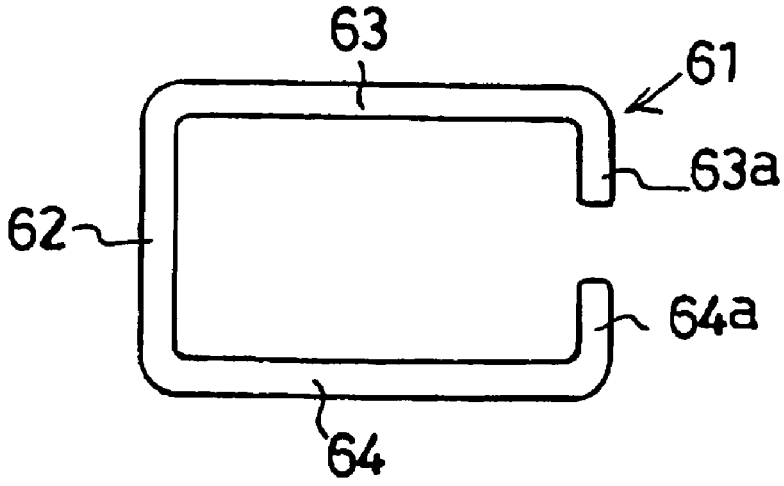
FIG. 15 is a front view of the guide lever shown in FIG. 14.

FIG. 14 is a plan view of a guide lever composing the latch device according to the embodiment of the present invention, and FIG. 15 is a front view of the guide lever shown in FIG. 14. As shown in FIGS. 14 and 15, the guide lever 61 is a metal bar folded in a U shape viewed from a front so that the axial portion 62 extending vertically has a first arm 63 and a second arm 64 horizontally extending in parallel at upper and lower sides thereof. Open ends of the first arm 63 and the second arm 64 are folded inwardly to form a space therebetween where the flat plate 40 of the movable member 31 can be inserted, and the first trace portion 63*a* and the second trace portion 64*a* are formed at the ends of the first arm 63 and the second arm 64 so that the guide lever 61 is integrally formed to have a C-shape.

Figure 16:
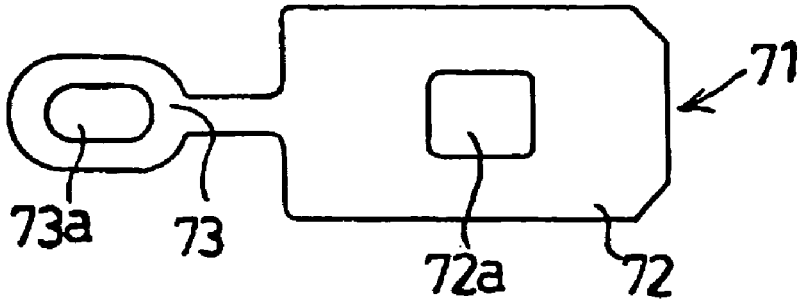
FIG. 16 is a plan view of a fixed terminal composing the latch device according to the embodiment of the present invention.
Figure 17:
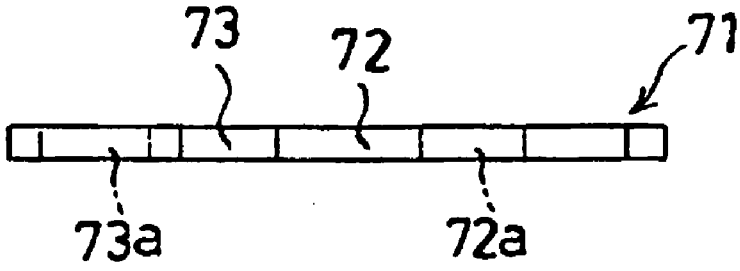
FIG. 17 is a front view of the fixed terminal shown in FIG. 16.

FIG. 16 is a plan view of the fixed terminal composing the latch device according to the embodiment of the present invention, and FIG. 17 is a front view of the fixed terminal shown in FIG. 16. As shown in FIGS. 16 and 17, a fixed terminal 71 composing a switch is formed of a conductive metallic flat plate, and includes a rectangular insertion portion 72 inserted into the housing 11, and a connecting portion 73 connected to the insertion portion 72 on a same plane and to be located at an outside of the housing 11. The insertion portion 72 is provided with a rectangular engagement hole 72*a* as an engagement portion for engaging the engagement projection 16*a* of the housing 11. The connecting portion 73 is provided with a through hole 73*a* for passing through a conducting wire to be connected.

Figure 18:
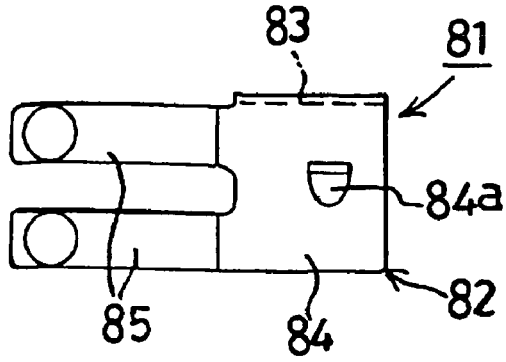
FIG. 18 is a plan view of a movable terminal composing the latch device according to the embodiment of the present invention.
Figure 19:
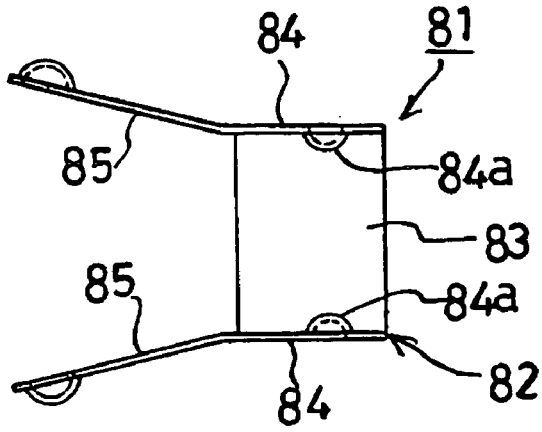
FIG. 19 is a front view of the movable terminal shown in FIG. 18.
Figure 20:
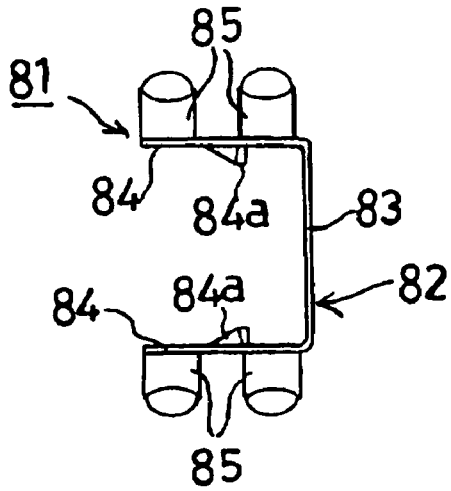
FIG. 20 is a right side view of the movable terminal shown in FIG. 18.

FIG. 18 is a plan view of a movable terminal composing the latch device according to the embodiment of the present invention, FIG. 19 is a front view of the movable terminal shown in FIG. 18, and FIG. 20 is a right side view of the movable terminal shown in FIG. 18.

As shown in FIGS. 18 to 20, a movable terminal 81 composing the switch is formed of a conductive metallic flat plate, and includes an attachment portion 82 having a U-shape viewed from the right side (direction that the movable member 31 is pushed in); and movable contact pieces 85 corresponding to the holding pieces 17 of the housing 11 and extending from supporting pieces 84 of the attachment portion 82 in the direction that the movable member 31 is pushed in. The attachment portion 82 includes a connecting piece 83 extending vertically, and the supporting pieces 84 extend from the connecting piece 83 in the same direction in parallel and connected to the movable pieces 85. Each of the supporting pieces 84 is provided with an engagement projection 84*a* for engaging the engagement hole 38 of the movable member 31. A pair of the movable contact pieces 85 has an interval in which the holding pieces 17 of the housing 11 can reciprocate.

FIGS. 21 to 25 are views for explaining an operation of the latch according to the embodiment of the present invention. In FIGS. 21 to 25, reference numeral 51 denotes a coil spring as the urging member for urging the movable member 31 in a direction that the movable member 31 projects from the housing 11. A striker S is provided on an opening-closing member such as a door.

A process of assembly will be explained next. First, the connecting piece 83 of the movable terminal 81 is disposed to correspond to the housing step portions 37 of the movable member 31. The square pole 35 is pushed between the supporting pieces 84 in a state where each of the supporting pieces 84 is pointed at the square pole 35. As a result, each of the engagement projections 84*a* moves on the square pole 35, so that the square pole 35 is inserted between the supporting pieces 84.

Figure 21:
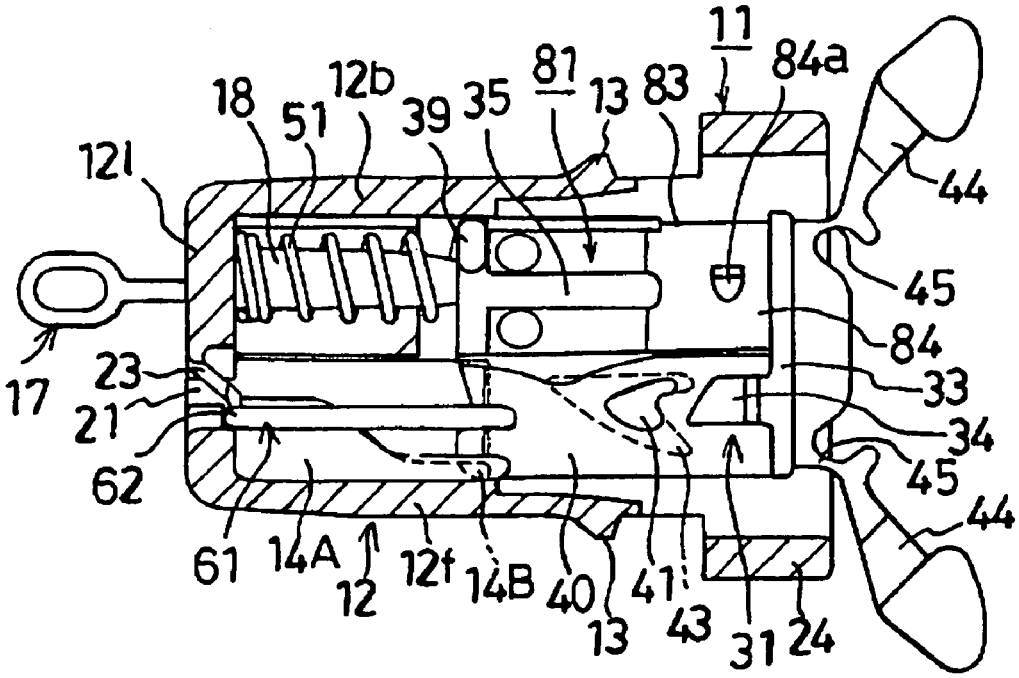
FIG. 21 is a view for explaining an operation of the latch device according to the embodiment of the present invention.

When the connecting piece 83 is housed in the housing step portions 37, the engagement projections 84*a* face the engagement holes 38, so that the supporting pieces 84 return to the original state by the elasticity of the connecting piece 83 and the supporting pieces 84. Accordingly, each of the engagement projections 84*a* enters each of the engagement holes 38 to engage an edge of the engagement hole 38, so that the movable terminals 81 are integrally attached to the movable member 31, as shown in FIG. 21.

When the movable terminals 81 are attached to the movable member 31, the front wall 33 and the housing step portions 37 restrict the movable terminals 81 not to move in the left-to-right direction. Outer surface of the connecting piece 83 becomes flush with the surfaces of the front wall 33 and the square pole 35. Each of the movable contact pieces 85 is inclined such that the movable contact pieces 85 are located away from the square pole 35 as the movable contact pieces 85 are located away from the front wall 33.

Next, one end of the coil spring 51 is inserted into the circular hole 36 of the movable member 31, and the other end of the coil spring 51 is disposed to correspond to the spring receiver 18 of the housing 11. While the engagement projection 34 of the movable member 31 is disposed to correspond to the guide long hole 15 and the guide groove 15*a* of the housing 11, the movable member 31 is inserted into the housing 11 from the protection and guide projections 39. As a result, each of the movable contact pieces 85 is bent toward the square pole 35 as an edge thereof is pushed by the inner surface of the box portion 12. Also, the engagement projection 34 pushes up the frame portion 24 with the inclined surface thereof, so that the main member 32 is inserted into the housing 11.

When the engagement projection 34 moves over the frame portion 24 and faces the guide long hole 15, the frame portion 24 returns to the original state by its own elasticity. Accordingly, the movable member 31 is urged with the coil spring 51 to project from the housing 11. As a result, the engagement projection 34 engages an edge of the guide long hole 15 (frame portion 24), so that the movable member 31 is attached to the housing 11, as shown in FIG. 21.

When the movable member 31 is attached to the housing 11 as shown in FIG. 21, the spring receiver 18 enters and supports the coil spring 51 so that the coil spring 51 does not buckle during expansion and contraction. As shown in FIG. 21, the flat plate 40 of the movable member 31 enters between the first cam projecting bar 14A and the second cam projecting bar 14B, so that the flat plate 40 is supported at the top and bottom thereof.

Next, the first trace portion 63*a* and the second trace portion 64*a* of the guide lever 61 are pointed to the left side surface wall 121 of the housing 11. The first trace portion 63*a* is up and the second trace portion 64*a* is down so that the guide lever 61 sandwiches the flat plate 40 of the movable member 31. In this state, when the guide lever 61 is inserted into the insertion hole 21 of the housing 11 from the first trace portion 63*a* and the second trace portion 64*a*, the axial portion 62 pushes and stretches the elastic pressing piece 23, so that the axial portion 62 is inserted into the depressions 22A and 22B.

When the axial portion 62 is inserted into the depressions 22A and 22B, the elastic pressing piece 23 returns to an original state by its elasticity as shown in FIG. 21. The elastic pressing piece 23 presses the axial portion 62 between the depressions 22A and 22B toward the first cam projecting bar 14A and the second cam projecting bar 14B. Accordingly, the guide lever 61 is attached without coming out and is rotatable inside the depressions 22A and 22B.

Next, the insertion portions 72 of the fixed terminals 71 are pointed to the left side surface wall 121 of the housing 11, and the insertion portions 72 are inserted into the insertion holes 19 of the housing 11. As a result, the insertion portions 72 push the engagement projections 16*a* of the engagement pieces 16, so that the engagement pieces 16 bend outside and the insertion portions 72 are inserted into the insertion hole 19.

When the insertion portions 72 are inserted into the insertion holes 19, the edges of the insertion portions 72 are held by the holding pieces 17 not to move upwardly. Accordingly, the engagement projections 16*a* face the engagement holes 72*a*, so that the engagement pieces 16 return to an original state by their elasticity. As a result, the engagement projections 16*a* enter the engagement holes 72*a* and engage edges of the engagement holes 72*a* (insertion portion 72), so that the fixed terminals 71 are attached without being slipped out of the housing 11.

A process of attaching the latch will be explained next. First, the left side surface wall 121 of the box portion 12 is disposed to correspond to an attached member, for example, an attachment hole of a bracket provided in a main body of a radio cassette corresponding to a rotational end of a door of the radio cassette. The latch device is inserted into the attachment hole from the left side surface wall 121 and pushed in. Accordingly, each of the elastic supporting pieces 13 is pushed by the edge of the attachment hole and bends inside, so that the box portion 12 is inserted into the attachment hole. When the frame portion 24 abuts against a surface of the bracket, each of the elastic supporting pieces 13 projects to the backside of the bracket and returns to the original state by its elasticity, so that each of the elastic supporting pieces 13 engages an edge of the attachment hole at the backside of the bracket. As a result, the latch device is attached to the bracket in the state where the elastic supporting pieces 13 and the frame portion 24 sandwich the bracket.

Figure 22:
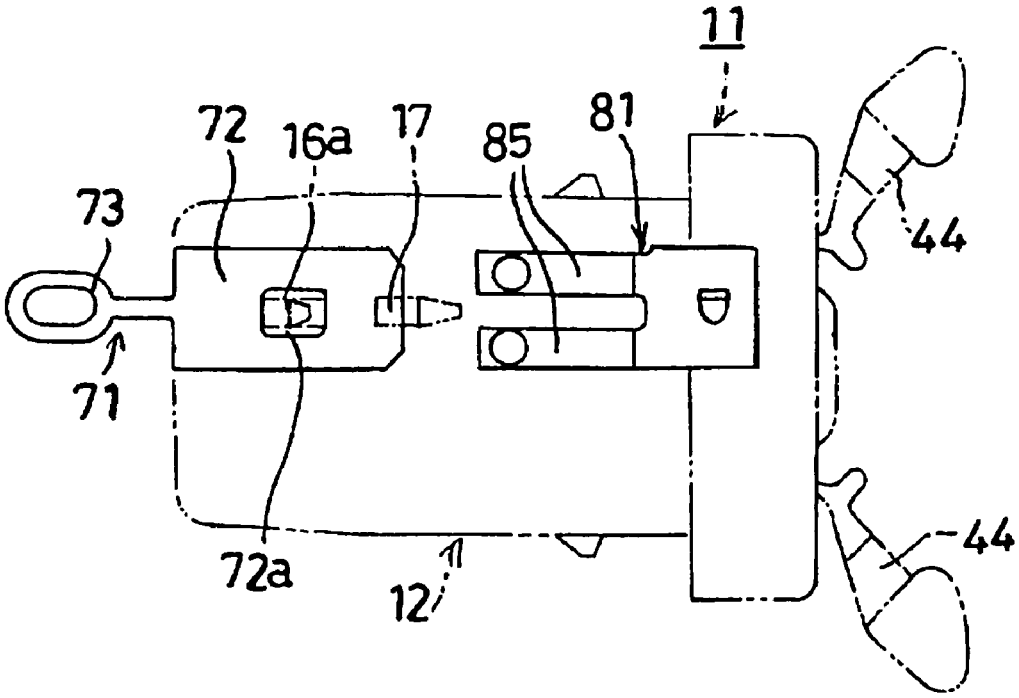
FIG. 22 is a view for explaining an operation of the latch device according to the embodiment of the present invention.

An operation of the latch will be explained next. First, in the assembled state shown in FIG. 21, the movable contact pieces 85 of the movable terminals 81 are located away from the corresponding insertion portions 72 of the fixed terminals 71 as shown in FIG. 22, so that the switch is in an off-state. In this state, when the front wall 33 of the movable member 31 is pushed by the striker S and pushed into the housing 11 against the force of the coil spring 51, each of the supporting pieces 44 is pushed by the frame portion 24 and bends inside at the hinge portion 45, so that the supporting pieces 44 sandwich the striker S not to slip out as shown in FIG. 23.

When the movable member 31 is pushed into the housing 11, each of the trace portions 63*a* and 64*a* of the guide lever 61 moves while tracing a lower portion of each of the heart cams 41 and 43 shown in FIG. 21. As a result, as shown in FIG. 23, the movable member 31 is pushed to the deepest portion of the housing 11. In this state, when the force that the movable member 31 is pushed into the housing 11 with the striker S is released, the movable member 31 is urged by the coil spring 51 in the direction that the movable member 31 projects from the housing 11.

Figure 24:
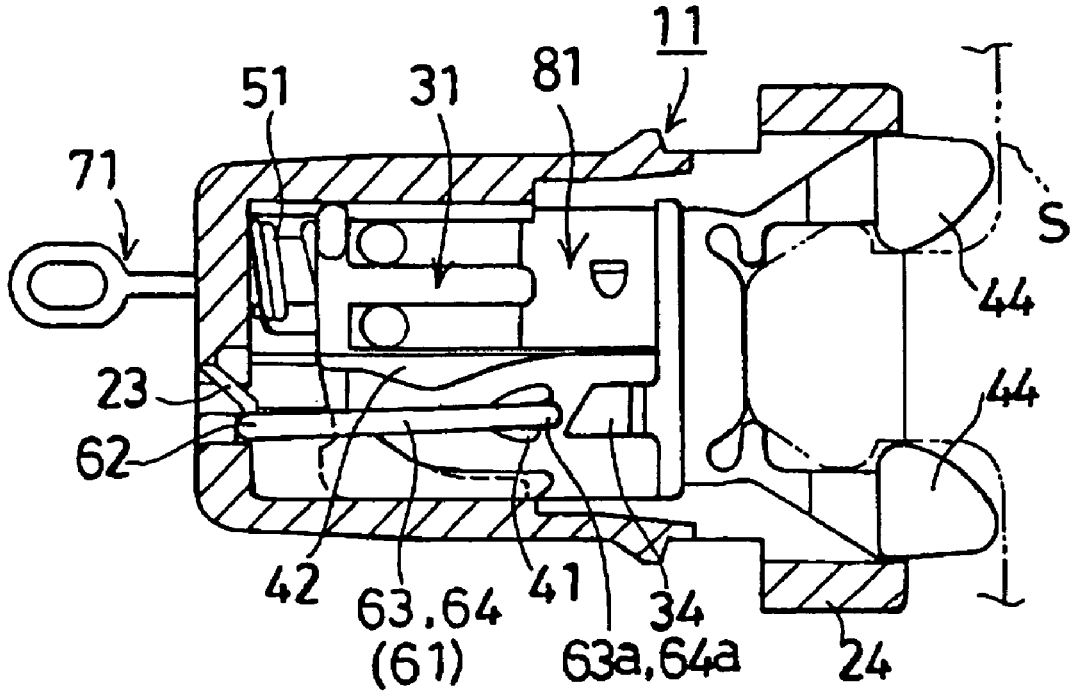
FIG. 24 is a view for explaining an operation of the latch device according to the embodiment of the present invention.
Figure 25:
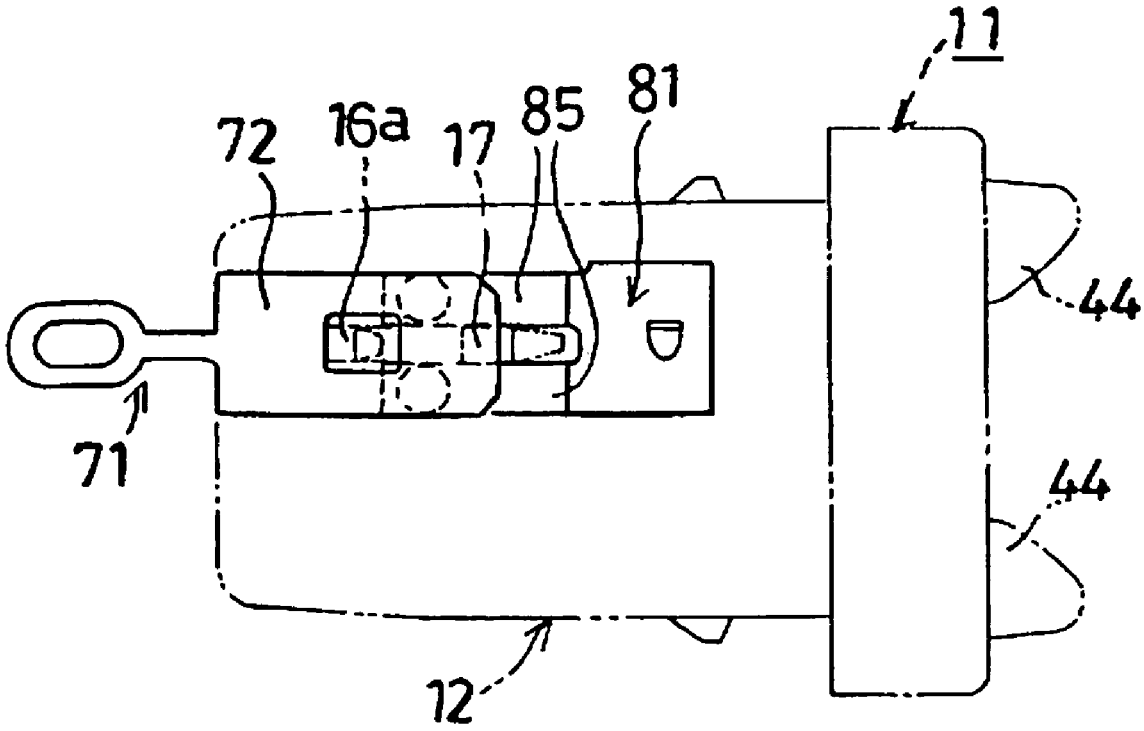
FIG. 25 is a view for explaining an operation of the latch device according to the embodiment of the present invention.

Accordingly, the second trace portion 64*a* is guided by the cam surface of the edge of the second heart cam 43 to generate the restoration force. As shown in FIG. 24, each of the trace portions 63*a* and 64*a* faces and engages each of the cam depressions 41*a* and 43*a*, so that the lock mechanism becomes a locked state and the movable member 31 is locked at the push-in position. When the movable member 31 is pushed into the housing 11 until the state shown in FIG. 24, the movable contact pieces 85 of the movable terminals 81 contact the corresponding insertion portions 72 of the fixed terminals 71 as shown in FIG. 25, so that the switch turns to the on-state.

Figure 23:
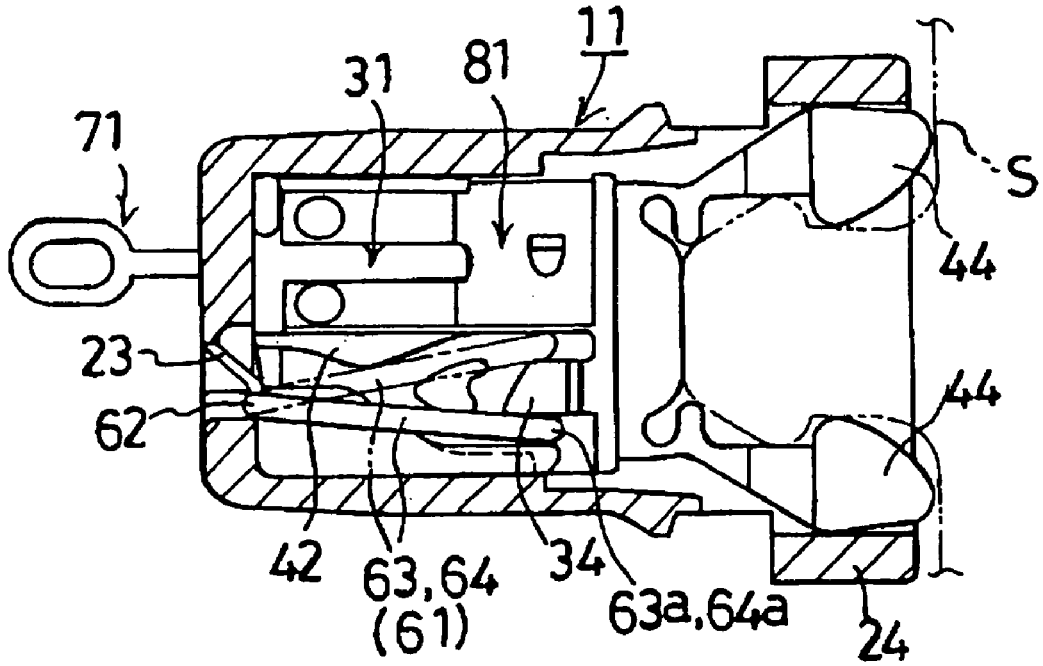
FIG. 23 is a view for explaining an operation of the latch device according to the embodiment of the present invention.

In the state where the lock mechanism is in the locked state, when the movable member 31 is pushed again into the housing 11 against the force of the coil spring 51 through the striker S, each of the trace portions 63*a* and 64*a* is guided by the inclined surface (cam surface) of the engagement projection 34 as indicated by phantom line in FIG. 23, so that the lock mechanism turns to the unlock state. Accordingly, in the unlock state, when the force that the movable member 31 is pushed into the housing 11 through the striker S is released, the movable member 31 is urged by the coil spring 51 in the direction that the movable member 31 projects from the housing 11, so that the movable member 31 returns to the projecting position as shown in FIG. 21. When the movable member 31 returns to the state shown in FIG. 21, the movable contact pieces 85 of the movable terminal 81 are away from the corresponding insertion portions 72 of the fixed terminals 71 as shown in FIG. 22, so that the switch turn to the off-state.

As described above, according to the embodiment of the present invention, the lock mechanism is provided on the two sides of the movable member 31 and the portions of the housing 11 corresponding to the two sides of the movable member 31, so that the locking strength is improved and the locking forces of the two sides is balanced. The switch is also provided on the two sides of the movable member 31 and the portions of the housing 31 corresponding to the two sides of the movable member 31. Therefore, the movable contact pieces 85 of the movable terminal 81 abut elastically against the inner surface of the housing 11 or the fixed terminal 71, so that the movable member 31 is reliably operated without inclining.

Further, the movable contact pieces 85 of the movable terminal 81 extend in the push-in direction of the movable member 31 and are provided on the lock mechanism side by side. Also, the movable terminal 81 composing the switch provided on the two sides of the movable member 31 is electrically connected. Accordingly, it is possible to reduce a width of the movable member 31 and a width of the latch. Also, the movable terminal 81 provided on the two sides of the movable member 31 is formed in a U-shape seen from the push-in direction of the movable member 31. Therefore, the movable terminal 81 can be attached to the movable member 31 by fitting the U-shaped part (attachment portion 82) into the movable member 31, thereby improving the operation for attaching the movable terminal 81 to the movable member 31.

When the attachment portions 72 of the fixed terminals 71 are inserted into the insertion holes 19 in the left side surface wall 121, the engagement projections 16*a* of the engagement pieces 16 engage the engagement holes 72*a* of the attachment portions 72, so that the fixed terminals 71 are attached to the housing 11. Accordingly, the operation of assembling the fixed terminals 71 is excellent, and it is possible to assemble by an automatic machine. Also, the fixed terminals 71 can be attached without slipping out.

Further, the holding pieces 17 hold the ends of the attachment portions 72 not to part from the inner surface of the housing 11. Therefore, the movable contact pieces 85 of the movable terminals 81 do not bend to be damaged.

In the embodiment described above, the movable terminal 81 is provided on the two sides of the movable member 31. Alternatively, the movable terminal may be provided only on the front surface or the back surface of the movable member 31, or a surface other than the front and back surfaces of the movable member 31. When the movable terminal is provided only on the front or the back surface of the movable member 31, or the surface other than the front and back surfaces of the movable member 31, the attachment portion may be formed in the U-shape shown in the embodiment, or the flat plate attachment portion may be inserted between the engagement pieces provided on the movable member.

Further, in the embodiment, the movable terminal 81 is provided on the two sides of the movable member 31 and is electrically conducted to be the switch for a single circuit. Alternatively, the movable terminal on the two sides may not be electrically connected with each other so that the movable terminal can serve as switches for two circuits. Moreover, the latch device is applied to the radio cassette, and the invention can be applied to other equipment.

As explained above, according to the present invention, the lock mechanism is provided on the two sides of the movable member and the portions of the housing corresponding to the two sides of the movable member. Therefore, the locking strength is improved, and the locking forces of the two sides are balanced. The switch is provided on the two sides of the movable member and the portions of the housing corresponding to the two sides of the movable member. Therefore, the movable contact pieces of the movable terminals elastically contact the inner surface of the housing, the fixed terminal, or the movable member, so that the movable member reliably operates without inclining.

Moreover, the terminals composing the switch are provided on the two sides of the movable member and are electrically connected. Therefore, it is possible to reduce the width of the movable member and the width of the latch. The terminals are provided on the two sides of the movable member and are formed in the U-shape seen from the push-in direction of the movable member. Therefore, the U-shaped parts (attachment portions) are fitted into the movable member, so that the terminal can be attached to the movable member, thereby improving the operation of attaching the movable terminal to the movable member.

While the invention has been explained with reference to the specific embodiments of the invention, the explanation is illustrative and the invention is limited only by the appended claims.

What is claimed is:

1. A latch device comprising:

a housing, a movable member axially slidably disposed in the housing to move between a lock position and an unlock position relative to the housing and having front and back surfaces, an urging member disposed in the housing for urging the movable member in a direction to project from the housing, a switch disposed in the housing for turning on and off according to a position of the movable member in the housing, said switch having a movable terminal attached to the movable member and a fixed terminal attached to the housing so that when the movable member is in the lock position, the movable terminal contacts the fixed terminal arid when the movable member is in the unlock position, the movable terminal is spaced from the fixed terminal, and a push-push type lock mechanism disposed in the housing for locking and unlocking the movable member inside the housing, and including first lock members disposed on the front and back surfaces of the movable member symmetrically with respect to a center plane between the front and back surfaces of the movable member, and second lock members situated at sides of the housing facing the first lock members and locking and unlocking with the first lock members, said second lock members being integrally formed to have a C-shape with ends engaging the first lock members, wherein said movable member is formed of a columnar portion on which a part of the switch is disposed, and a plate portion attached to one side of the columnar portion on which the first lock members are formed symmetrically.

2. A latch device according to claim 1, wherein the movable member is locked in the lock position inside the housing by pushing the movable member into the housing against an urging force of the urging member, said locking mechanism releasing the movable member by pushing the movable member again into the housing to thereby return the movable member by the urging force.

3. A latch device according to claim 1, wherein said movable terminal includes first switch terminals disposed on the front and back surfaces of the movable member, and the fixed terminal includes second switch terminals situated at the sides of the housing facing the first switch terminals.

4. A latch according to claim 3, wherein said first switch terminals are electrically connected together.

5. A latch device according to claim 4, wherein said first switch terminals are formed in a U-shape.

6. A latch device according to claim 5, wherein each of said second switch terminals has an engaging portion engaging the housing and projects outwardly from the housing when the second switch terminal is fixed to the housing through the engaging portion.

7. A latch device according to claim 1, wherein said movable member further includes engaging pieces pivotally attached to one end thereof, said engaging pieces holding a member therebetween when the engaging pieces are located inside the housing.

* * * * *